US009052688B2

(12) United States Patent
Sekido

(10) Patent No.: US 9,052,688 B2
(45) Date of Patent: Jun. 9, 2015

(54) IMAGE FORMING APPARATUS

(71) Applicant: CANON KABUSHIKI KAISHA, Tokyo (JP)

(72) Inventor: Kota Sekido, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 48 days.

(21) Appl. No.: 13/894,473

(22) Filed: May 15, 2013

(65) Prior Publication Data

US 2013/0308976 A1 Nov. 21, 2013

(30) Foreign Application Priority Data

May 21, 2012 (JP) ..... 2012-115845

(51) Int. Cl.
*G03G 21/18* (2006.01)
*G03G 21/16* (2006.01)

(52) U.S. Cl.
CPC ..... *G03G 21/1842* (2013.01); *G03G 21/1623* (2013.01); *G03G 21/1853* (2013.01); *G03G 2221/1684* (2013.01); *G03G 2221/1869* (2013.01)

(58) Field of Classification Search
CPC ..... G03G 21/1846; G03G 21/1853
USPC ..... 399/111, 112
See application file for complete search history.

(56) References Cited

U.S. PATENT DOCUMENTS

| | | | | |
|---|---|---|---|---|
| 7,848,685 | B2 | 12/2010 | Nagashima et al. | |
| 8,010,014 | B2 | 8/2011 | Noguchi | |
| 8,320,801 | B2 | 11/2012 | Nagashima et al. | |
| 8,369,753 | B2 | 2/2013 | Nagashima et al. | |
| 8,463,164 | B2 | 6/2013 | Nagashima et al. | |
| 8,472,848 | B2 | 6/2013 | Nagashima et al. | |
| 8,509,658 | B2 | 8/2013 | Nagashima et al. | |
| 8,693,926 | B2 | 4/2014 | Nagashima et al. | |
| 2006/0228131 | A1* | 10/2006 | Kimura et al. | 399/111 |
| 2010/0080617 | A1 | 4/2010 | Noguchi | |
| 2013/0336680 | A1 | 12/2013 | Nagashima et al. | |
| 2014/0169838 | A1 | 6/2014 | Nagashima et al. | |

FOREIGN PATENT DOCUMENTS

| | | | |
|---|---|---|---|
| JP | 3094229 | B2 | 10/2000 |
| JP | 2007-213012 | A | 8/2007 |
| JP | 2010-151952 | A | 7/2010 |

* cited by examiner

*Primary Examiner* — Gregory H Curran
(74) *Attorney, Agent, or Firm* — Fitzpatrick, Cella, Harper & Scinto

(57) ABSTRACT

An image forming apparatus includes an accommodating portion, a feeding portion for feeding recording materials from an end side of the accommodating portion, and a cartridge supporting member provided above the accommodating portion. The cartridge supporting member is movable to a mounting and demounting portion where cartridges are detachably mountable outside a main assembly of the image forming apparatus and to an image forming position where the cartridges are capable of forming the image inside the main assembly. At the image forming position, a side of the cartridge supporting member that opposes another end side of the accommodating portion in the vertical direction is lower than that of a side of the cartridge supporting member that opposes the end side of the accommodating portion.

9 Claims, 15 Drawing Sheets

(a)

(b)

(a)

(b)

IMAGE FORMING APPARATUS

FIELD OF THE INVENTION AND RELATED ART

The present invention relates to an image forming apparatus, to which a cartridge is detachably mountable, for forming an image on a recording material (medium).

The image forming apparatus forms the image on the recording material by using, e.g., an image forming process such as an electrophotographic process, an electrostatic recording process or a magnetic recording process. The image forming apparatus includes a copying machine, a printer (an LED printer, a laser beam printer, or the like), a facsimile machine, a multi-function machine of these machines, and the like. On the recording material, the image is formed by the image forming apparatus, and the recording material may include, e.g., paper, an OHT sheet, a label, and the like.

The cartridge is, e.g., a process cartridge or a developing cartridge, and contributes to the image forming process, for forming the image on the recording material, in a state in which the cartridge is detachably mounted in an apparatus main assembly of the image forming apparatus. The apparatus main assembly is an apparatus constituent portion obtained by removing the cartridge from constituent elements (members of the image forming apparatus).

The process cartridge is prepared by integrally assembling an image bearing member on which a latent image is formed, and at least one of process means acting on the image bearing member, such as a charging means, a developing means and a cleaning means, into a cartridge (unit), which is detachably mountable to the apparatus main assembly. The image bearing member is an electrophotographic photosensitive member in the electrophotographic process, an electrostatic recording dielectric member in the electrostatic recording process, a magnetic recording magnetic member in the magnetic recording process, and the like. The process cartridge is mountable to and demountable from the apparatus main assembly by a user himself (herself). For that reason, maintenance of the apparatus main assembly can be easily performed.

Accordingly, the process cartridge includes a cartridge which is prepared by integrally assembling the image bearing member and the developing means as the process means into a cartridge (unit), which is detachably mountable to the apparatus main assembly. The process cartridge integrally including the image bearing member and the developing means is referred to as a so-called integral type process cartridge. Further, the process cartridge integrally includes the image bearing member and the process means other than the developing means is referred to as a so-called (function) separation type process cartridge. That is, the developing means is provided in a developing unit other than the process cartridge, and the process cartridge for forming the image by being paired with the developing unit is referred to as the so-called separation type process cartridge.

Further, the developing cartridge includes a developing roller (developer carrying member) and accommodates a developer (toner) used for developing the latent image, formed on the image bearing member, by the developing roller, and is detachably mountable to the apparatus main assembly. Also the developing cartridge can be mounted to and demounted from the apparatus main assembly by the user himself (herself). For that reason, the maintenance of the apparatus main assembly can be easily performed.

In the case of the developing cartridge, the image bearing member is mounted in the apparatus main assembly or a cartridge supporting member. Alternatively, the image bearing member is provided in the so-called separation type process cartridge. In this case, the process cartridge does not include the developing means.

Therefore, the cartridge includes the so-called integral type process cartridge or the so-called separation type process cartridge. Further, the cartridge includes the case where the so-called separation type process cartridge and the developing cartridge are used in a pair. Further, the cartridge includes the case where the image bearing member is fixedly mounted in the apparatus main assembly or the cartridge supporting member and the developing cartridge is used so as to be actable on the image bearing member and so as to be detachably mountable. Further, the cartridge includes a developer cartridge in which the developer (toner) to be supplied to the process cartridge, the developing cartridge, or the like.

For convenience, an electrophotographic image forming apparatus such as a printer using the electrophotographic process will be described as an example. The electrophotographic photosensitive member as the image bearing member is electrically charged uniformly and then is subjected to selective exposure to light, so that the latent image is formed. Then, the latent image is developed with the developer to be visualized as a developer image, and then the developer image is transferred onto the recording material. By applying heat and pressure to the transferred developer image, the developer image is fixed as a fixed image on the recording material to record (form) an image.

Such an electrophotographic image forming apparatus was involved in developer supply or maintenance of various process means. As a means for facilitating the developer supplying operation or the maintenance, all or part of the electrophotographic photosensitive member, the charging means, the developing means, the cleaning means, and the like is integrally (collectively) assembled into a cartridge. Further, a cartridge type in which the cartridge is detachably mountable to the apparatus main assembly of the electrophotographic image forming apparatus is employed.

According to this cartridge type, the maintenance of the apparatus can be performed by the user himself (herself) in a manner of cartridge exchange, and therefore operativity was able to be remarkably improved. Therefore, the cartridge type has been widely used in the electrophotographic image forming apparatus.

Here, there is the electrophotographic image forming apparatus in which a plurality of cartridges is provided and arranged in a substantially horizontal direction. In order to facilitate mounting and demounting of the cartridge, a constitution in which the plurality of cartridges is integrally pulled out has been proposed (Japanese Laid-Open Patent Application (JP-A) 2007-213012). Further, in this constitution, a supporting member which is a movably member capable of being inserted into and pulled out from the electrophotographic image forming apparatus is provided, and the plurality of cartridges is mounted on the supporting member.

However, in recent years, a demand for downsizing of the image forming apparatus in order to realize space saving and cost reduction has been increased. However, in a conventional image forming apparatus, above a sheet feeding and stacking portion with respect to a vertical direction and in a side where there was no feeding means such as a feeding roller or the like, there was an area indicated by a broken line shown in FIG. 19. This space was a dead space which was not used for some purpose.

SUMMARY OF THE INVENTION

The present invention is further development of the above-described conventional constitution. A principal object of the present invention is to provide an image forming apparatus which has realized downsizing thereof by using a dead space as described above.

According to an aspect of the present invention, there is provided an image forming apparatus for forming an image on a plurality of recording materials, the image forming apparatus comprising: an accommodating portion for accommodating the plurality of recording materials; feeding means for feeding the recording materials from an end side of the accommodating portion; and a cartridge supporting member provided above the accommodating portion with respect to a vertical direction, wherein the cartridge supporting member is movable, in a direction perpendicular to an axial direction of the feeding means, to a mounting and demounting position where a plurality of cartridges is detachably mountable outside a main assembly of the image forming apparatus and to an image forming position where the plurality of cartridges is capable of forming the image inside the main assembly, and wherein at the image forming position, such a side of the cartridge supporting member as opposes another end side of the accommodating portion with respect to the vertical direction is lower with respect to the vertical direction than such a side of the cartridge supporting member as opposes the end side of the accommodating portion.

These and other objects, features and advantages of the present invention will become more apparent upon a consideration of the following description of the preferred embodiments of the present invention taken in conjunction with the accompanying drawings.

Figure 13:
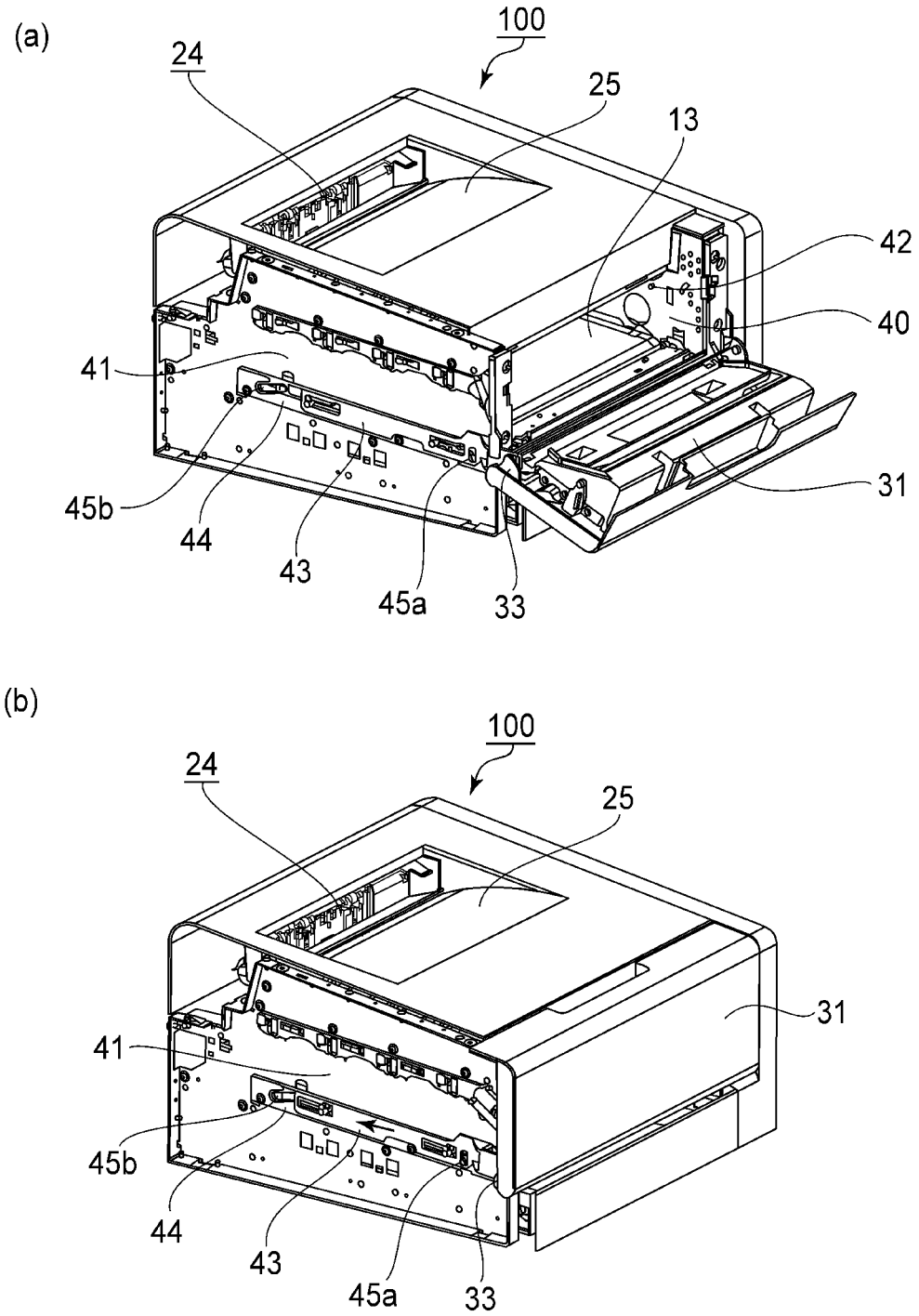

Parts (a) and (b) of FIG. 13 are perspective views each showing a structure of a mechanism for moving the tray upward and downward, at an outer portion of a side plate of the image forming apparatus, in interrelation with the door.

Figure 14:
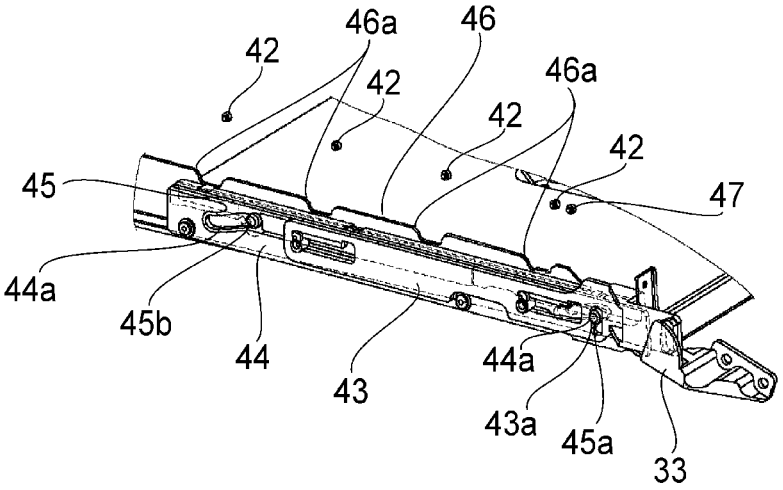
Figure 14:
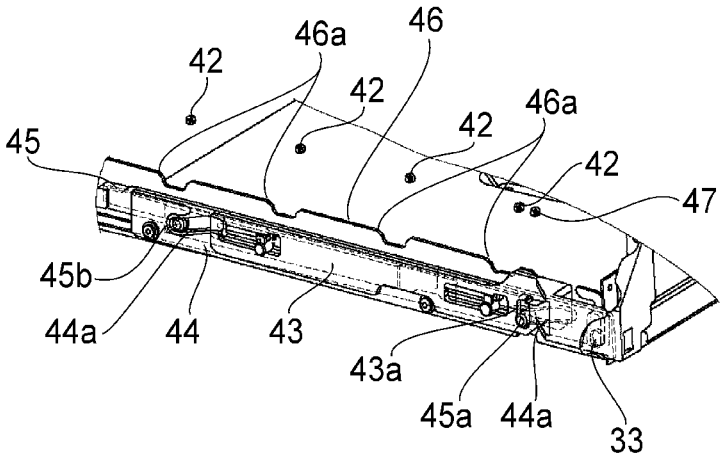

Parts (a) and (b) of FIG. 14 are perspective view each showing details of the mechanism for moving the tray upward and downward in interrelation with the door in Embodiment 1.

Figure 15:
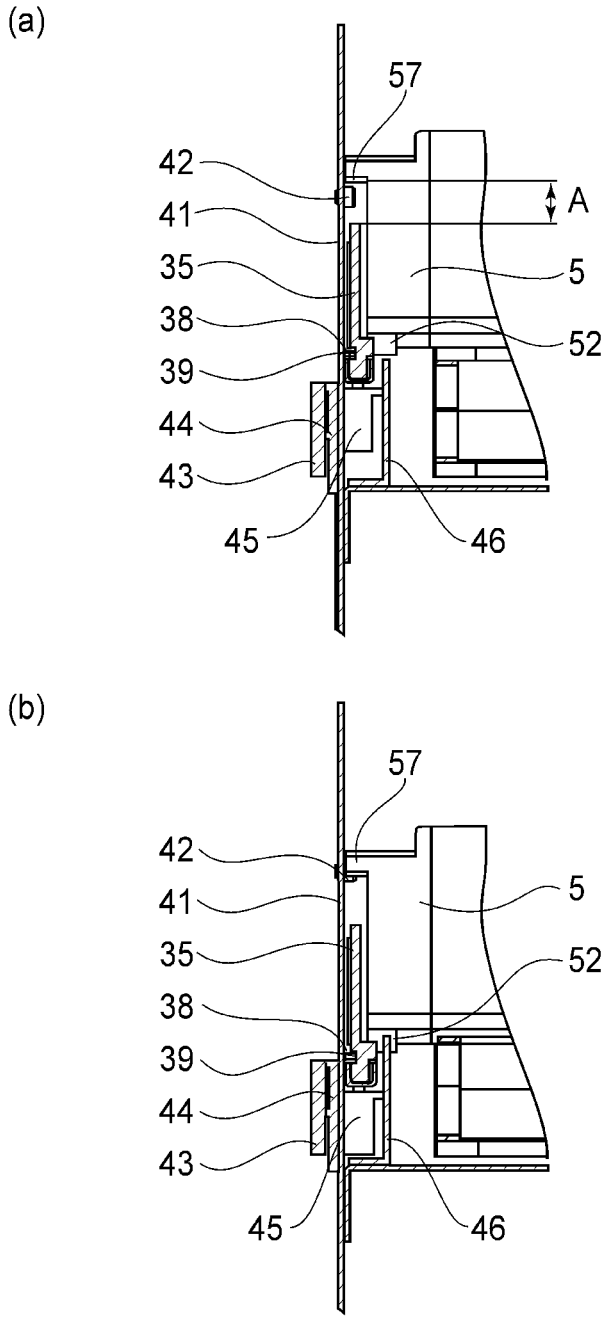

Parts (a) and (b) of FIG. 15 are sectional views each showing the details of the mechanism for moving the tray upward and downward in interrelation with the door in Embodiment 1.

Figure 16:
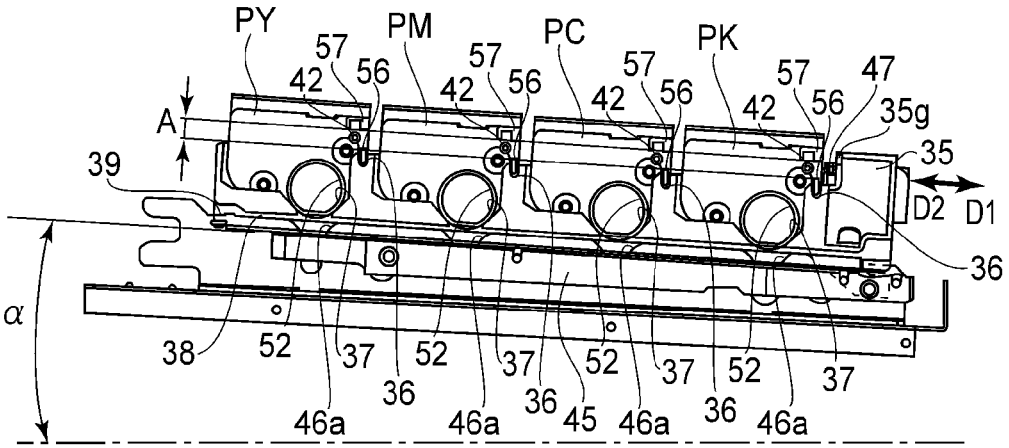
Figure 16:
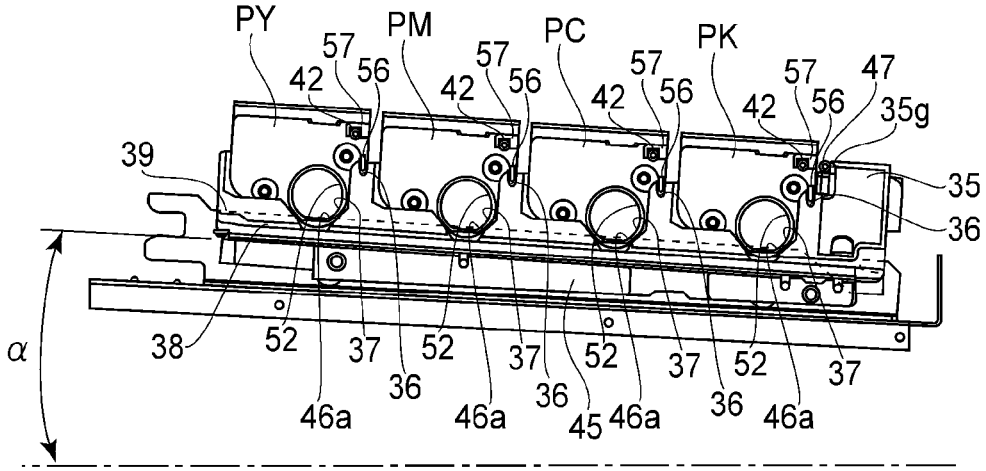

Parts (a) and (b) of FIG. 16 are side views each showing the details of the mechanism for moving the tray upward and downward in interrelation with the door in Embodiment 1.

Figure 17:
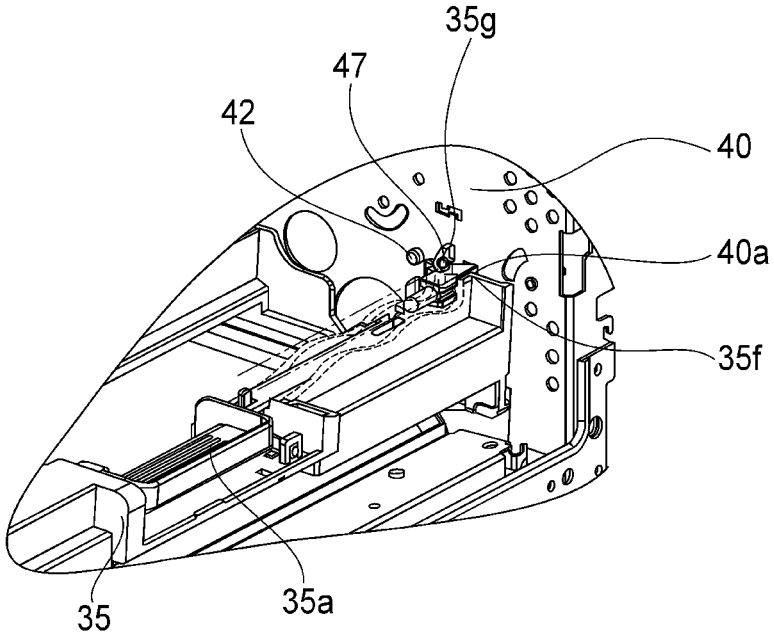

FIG. 17 is a perspective view showing a (safety) stopper claw of the tray in Embodiment 1 and its neighborhood.

Figure 18:
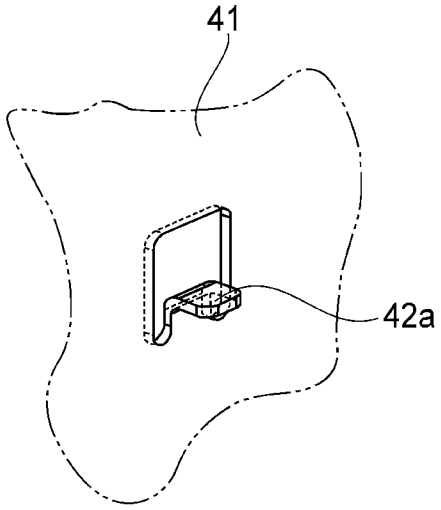

FIG. 18 is a perspective view showing another example of a rotation stopper shape.

Figure 19:
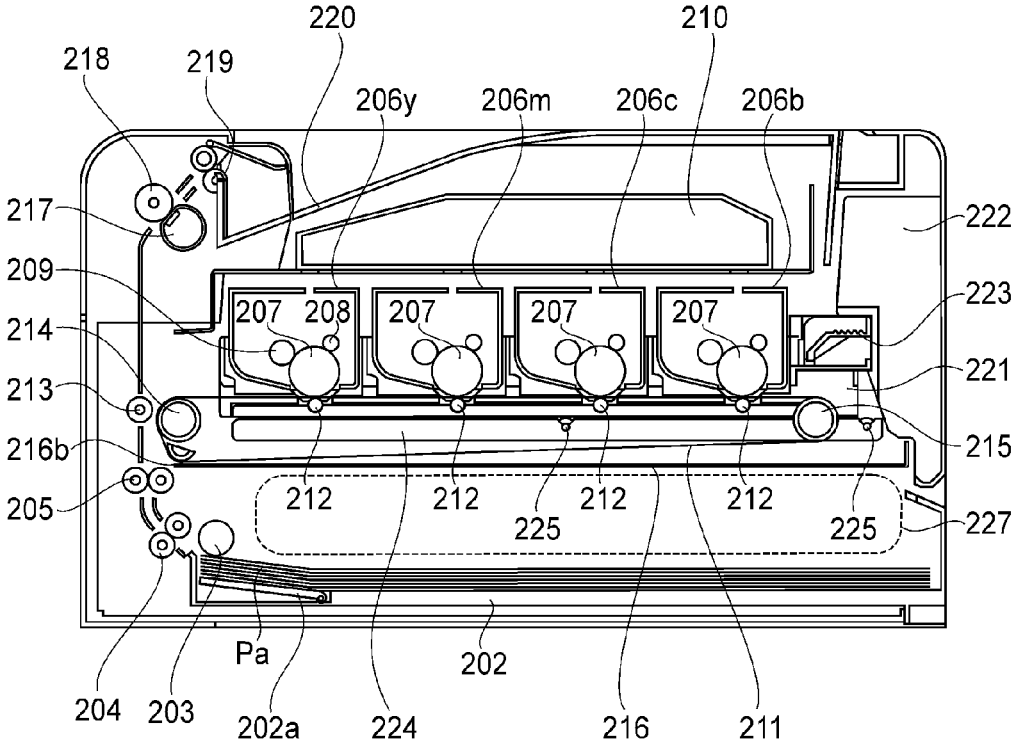

FIG. 19 is a principal sectional view of a conventional image forming apparatus.

DESCRIPTION OF THE PREFERRED EMBODIMENTS

Embodiment 1

General Structure of Image Forming Apparatus

Figure 1:
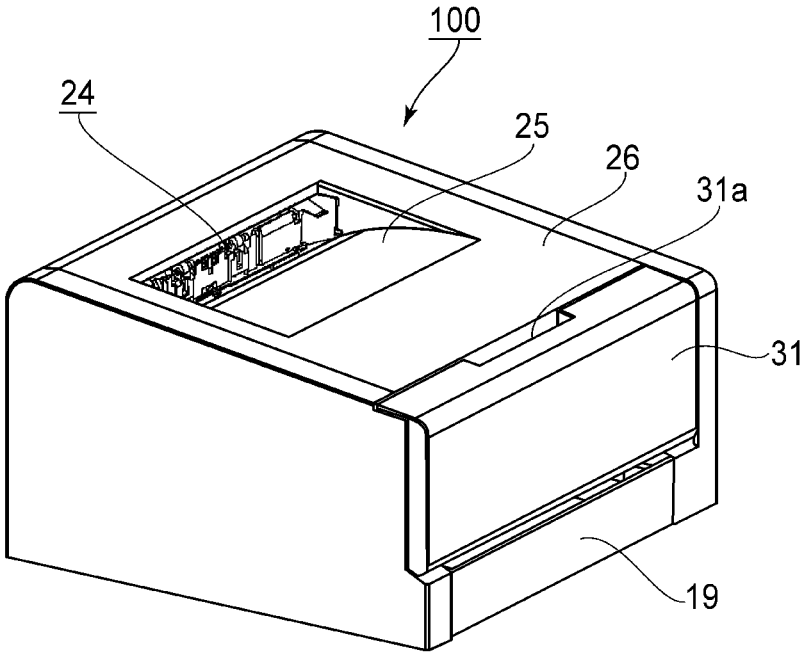
FIG. 1 is a perspective view of a cartridge showing a state in which a door of an image forming apparatus in Embodiment 1 is closed.
Figure 2:
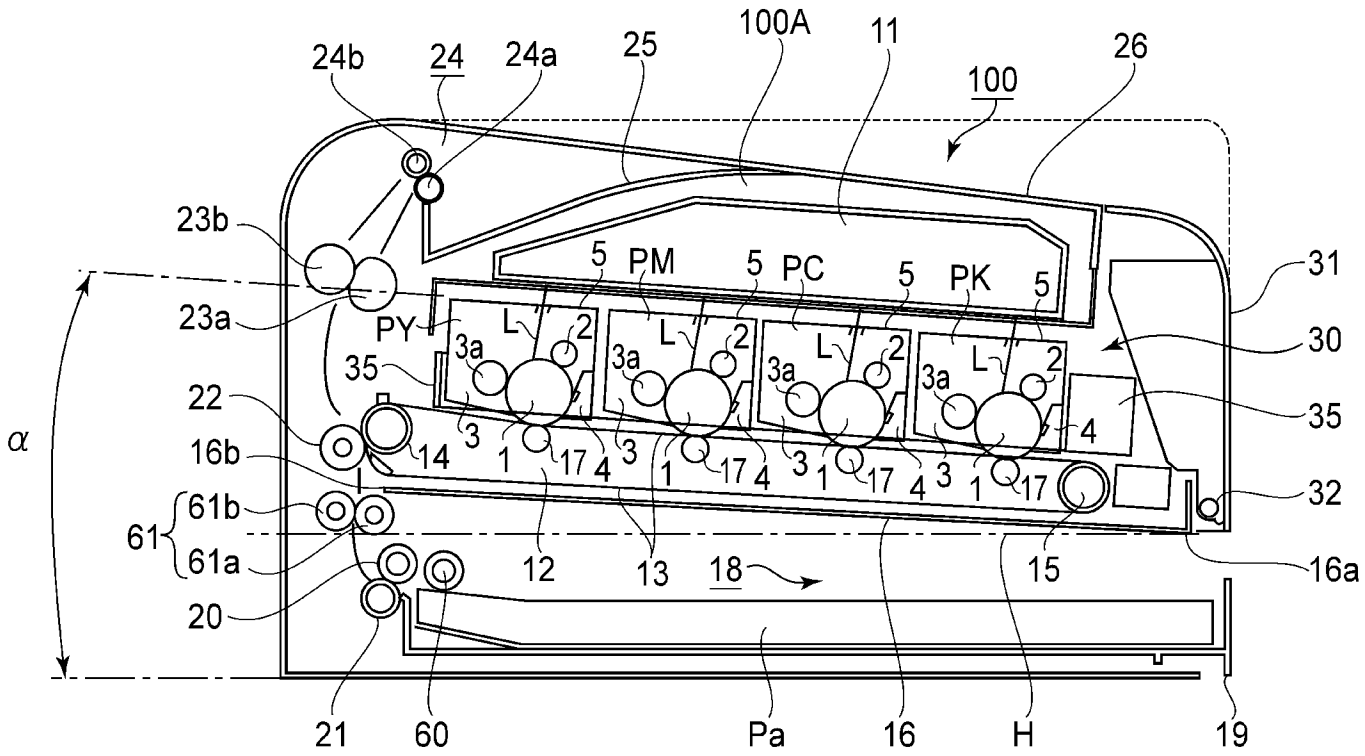
FIG. 2 is a principal sectional view showing the state in which the door of the image forming apparatus in Embodiment 1 is closed.

A general structure of an image forming apparatus 100 will be described with reference to FIGS. 1, 2, 7 and 8. FIG. 1 is a perspective view of an outer appearance of the image forming apparatus 100 in this embodiment, and FIG. 2 is a sectional view of the image forming apparatus 100. The image forming apparatus 100 is a four color-based full-color laser printer using an electrophotographic process, and executes image formation on a recording material (sheet) on the basis of an electrical image signal inputted from an external host device (not shown) such as a personal computer or an image reader.

In the following description, with respect to an apparatus main assembly 100A of the image forming apparatus 100, a front side (front surface side) means the side where an apparatus opening/closing door 31 is provided. A rear side is the side opposite to the front side. A front-rear direction includes a frontward direction toward front as seen from the rear side of the apparatus main assembly 100A and a rearward direction opposite to the frontward direction. The left and right sides means the left and right sides as seen from the front side of the apparatus main assembly 100A. A left-right direction includes a leftward direction from right toward left as seen from the front side and a rightward direction opposite to the leftward direction.

Figure 7:
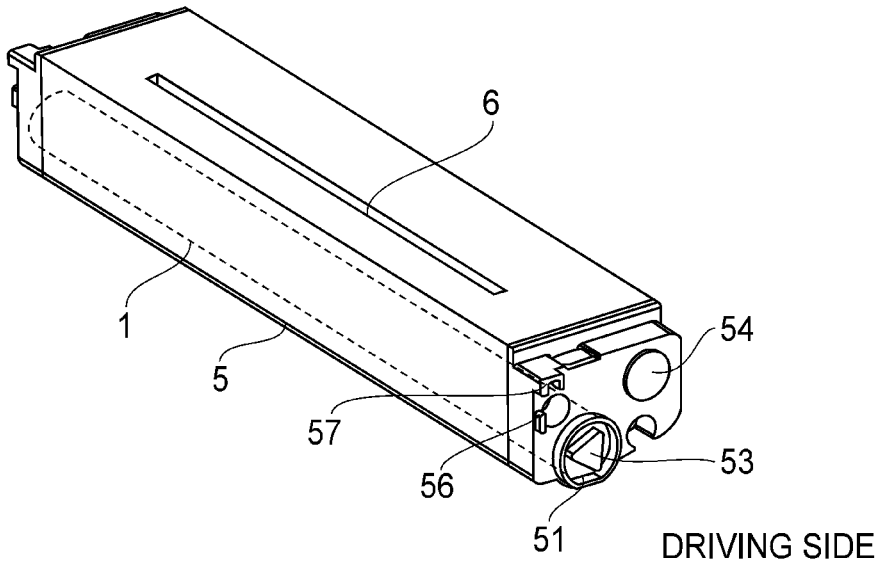
FIG. 7 is a perspective view of an outer appearance of a cartridge as seen from a driving side of the cartridge.
Figure 8:
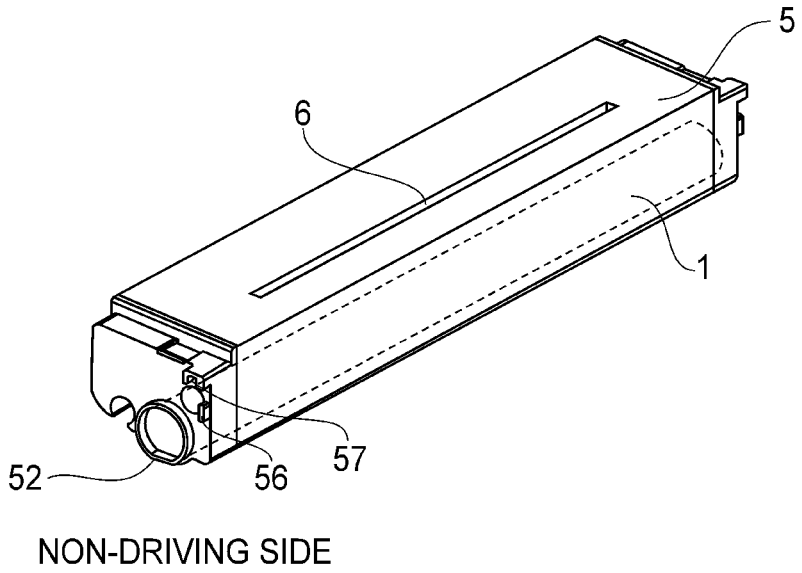
FIG. 8 is a perspective view of the outer appearance of the cartridge as seen from a non-driving side of the cartridge.

In the apparatus main assembly 100A, four (first to fourth) process cartridges P (PY, PM, PC and PK) are juxtaposed from the rear side to the front side (inline constitution, tandem type). The respective cartridges P have the same constitution except that colors of toners accommodated therein are different from each other. Each cartridge P in this embodiment is prepared by integrally assembling an electrophotographic photosensitive drum 1 as a first image bearing member, and as process means acting on the drum 1, a charging device 2, a developing device 3 and the cleaning device 4, in a cartridge frame 5 (FIGS. 7 and 8). The charging device 2 is contact charging roller, and in a developer container, a developer (toner) is accommodated. The cleaning device is of a blade type.

The developing device 3 of the first cartridge PY accommodate yellow (Y) toner, and on the surface of the drum 1, a toner (developer) image of yellow (Y) is formed. The developing device 3 of the second cartridge PM accommodates magenta (M) toner, and on the surface of the drum 1, a toner image of magenta (M) is formed. The developing device 3 of the third cartridge PC accommodates cyan (C) toner, and on the surface of the drum 1, a toner image of cyan (C) is formed. The developing device 3 of the fourth cartridge PK accommodates black (K) toner, and on the surface of the drum 1, a toner image of black (K) is formed.

Above the cartridges P, a laser scanner unit 11 is provided. This scanner unit 11 outputs laser light L modulated correspondingly to image information for each color inputted from the external host device to subject the drum surface of each cartridge P to scanning exposure through an exposure window 6 (FIGS. 7 and 8) provided at an upper surface of the cartridge frame 5.

Under the cartridges P, an intermediary transfer belt unit 12 as a transfer member is provided. The belt unit 12 includes, as an intermediary transfer member (second image bearing member), an endless belt which is formed of a dielectric material and which has flexibility, and includes a driving roller 14 and a tension roller 15 around which the belt 13 is extended and stretched to be moved and circulated.

The driving roller 14 is disposed on the rear side of the apparatus main assembly 100A. The tension roller 15 is disposed on the front side of the apparatus main assembly 100A. The drum 1 of each cartridge P contacts, at its lower surface, an upper surface of an upper belt portion of the belt 13. Inside the belt 13, four primary transfer rollers 17 are provided opposed to the drum 1 of the corresponding cartridge P through the upper belt portion of the belt 3. Toward the driving roller 14, a secondary transfer roller 22 is contacted to the belt 13.

Further, below the belt unit 12 with respect to a vertical direction, a sheet feeding unit 18 is disposed, and includes a sheet feeding tray 19, a pick-up roller 60 as a feeding means, a feeding roller 20, and a separation roller 21, and the like. The sheet feeding toner 19 as a recording material accommodating portion can be finely inserted into and taken out from the apparatus main assembly 100A from the front side (front loading). The sheet feeding tray 19 is constituted so as to be movable in a direction crossing axes of the pick-up roller 60, the sheet feeding roller 20 and the separation roller 21.

Further, with respect to the vertical direction, between the belt unit 12 and the sheet feeding unit 1, a stay 16 as a partitioning member is provided. When another part contacts the surface of the belt 13, an image quality is adversely affected, and therefore the stay 16 partitions the belt 13 and the sheet feeding unit 18 with respect to the vertical direction.

At an upper portion in the rear side of the apparatus main assembly 100A, a fixing device 23 and a sheet discharging roller pair 24 are provided. Further, an upper surface of the apparatus main assembly 100A is configured as a sheet discharging tray 25. The fixing device 23 includes a fixation film assembly 23*a* and a pressing roller 23*b*. The sheet discharging roller pair 24 includes sheet discharging rollers 24*a* and 24*b*.

Each cartridge P in a state in which it is mounted in the apparatus main assembly 100A at a mounting position is held in a state in which each cartridge P is fixed at a predetermined positioning portion described later. Further, to a driving force input portion of the cartridge P, a driving force output portion of the apparatus main assembly 100A is connected. Further, to an electrical contact of the cartridge P, an electric energy supplying system of the apparatus main assembly 100A is electrically connected.

An operation for forming a full-color image is as follows. The drum 1 of each of the first to fourth cartridges P is rotationally driven at a predetermined control speed. Further, also the belt 13 is rotationally driven. The scanner unit 11 is also driven. In synchronization with the driving of the scanner unit 11, the charging roller 2 in each cartridge P uniformly electrically charges the surface of the drum 1 to predetermined polarity and potential at predetermined control timing. The scanner unit 11 scans (exposes) the surface of each drum 1 with the laser light L modulated correspondingly to the image signal for an associated color. As a result, an electrostatic latent image corresponding to the image signal for the associated color is formed on the surface of the drum 1. T thus formed electrostatic latent image is developed by the developing device 3 into a toner image.

By the above-described electrophotographic image forming process operation, a yellow toner image which corresponds to the yellow component of a full-color image is formed on the drum 1 of the first cartridge PY, and this toner image is primary-transferred onto the belt 13.

On the drum 1 of the second cartridge PM, a magenta toner image which corresponds to the magenta component of the full-color image is formed, and this toner image is primary-transferred onto the belt 13 so that it is superposed on the yellow toner image which has already been transferred on the belt 13.

On the drum 1 of the third cartridge PC, a cyan toner image which corresponds to the cyan component of the full-color image is formed, and this toner image is primary-transferred onto the belt 13 so that it is superposed on the yellow and magenta toner images which have already been transferred the belt 13.

On the drum 1 of the fourth cartridge PK, a black toner image which corresponds to the black component of the full-color image is formed, and this toner image is primary-transferred onto the belt 13 so that it is superposed on the yellow, magenta, and cyan toner images which have already been transferred on the belt 13.

Consequently, an unfixed full-color toner image is synthetically formed on the belt 13 by the yellow, magenta, cyan and black toner images.

A transfer residual toner remaining on the surface of the drum 1 at each cartridge P is removed by the cleaning device 4.

Meanwhile, the pick-up roller 60 is rotationally driven at predetermined control timing. One of sheets Pa as the recording material stacked on the sheet feeding tray 19 is fed from an (one) end side of the sheet feeding tray 19 with respect to a feeding direction of the sheet Pa. The sheets Pa are separated and fed one by one by the sheet feeding roller 20 and the separation roller 21, thus being conveyed to a conveying roller pair 61 (61*a*, 61*b*). Then, the conveying roller pair 61 conveys the sheet Pa to a nip (secondary transfer nip), between the secondary transfer roller 22 and the belt 13, which is a transfer position provided in a downstream side with respect to the feeding direction of the sheet Pa. As a result, during nip-conveyance of the sheet S through the nip, the superposed four color toner images are simultaneously (collectively) transferred onto the sheet Pa.

The sheet Pa is separated from the surface of the belt 13 and introduced into the fixing device 23, and is heated and pressed in a fixing nip of the fixing device 23. As a result, color mixing of the respective color toner images and fixation thereof on the sheet Pa are performed. Thereafter, the sheet Pa is moved out of the fixing device 23, and then is discharged as a full-color image formation product onto the sheet discharge tray 25 by the sheet discharging roller pair 24.

A secondary-transfer residual toner remaining on the surface of the belt 13 is, in this embodiment, electrostatically deposited on the drum 1 surface at the primary transfer portion of, e.g., the first process cartridge PY and is removed by the cleaning device 4.

(Cartridge Exchange)

A cartridge exchanging (replacing) method will be described with reference to FIGS. 1 to 11. With use of each of the first to fourth cartridges P for image formation, the developer (toner) accommodated in the developing device 3 is consumed. Then, when the developer is consumed to such an extent that an image of a quality satisfactory to a user who has purchased the cartridge P cannot be formed, the exchange of the cartridge P is required.

Therefore, e.g., the image forming apparatus is provided with a means (not shown) for detecting an amount of the developer remaining in individual cartridge P. The detected amount of the developer in each cartridge P is compared, by the controller, with a threshold (value) preset for providing a prewarning or warning of its lifetime of the cartridge P. When the detected amount of the residual developer in the cartridge P is smaller than the preset threshold, the prewarning or warning of the lifetime of the cartridge P is displayed on a display portion. As a result, the image forming apparatus prompts the user to prepare a cartridge for exchange, or to replace the cartridge P with a fresh cartridge, in order to maintain an output image quality.

In the image forming apparatus in this embodiment, the exchange (replacement) of the cartridge P is performed through a method in which the cartridge P is placed on a tray to be pulled out and then is replaced in a front-access manner in order to improve usability.

In the front side of the image forming apparatus 100, an opening 30 (FIG. 2) through which the cartridge P passes in order that the cartridge P is inserted into the apparatus main assembly 100A and is taken out from the apparatus main assembly 100A is provided.

Further, a door (opening/closing member) 31 movable between a closing position where the opening 30 is closed and an opening position where the opening 30 is open.

Figure 3:
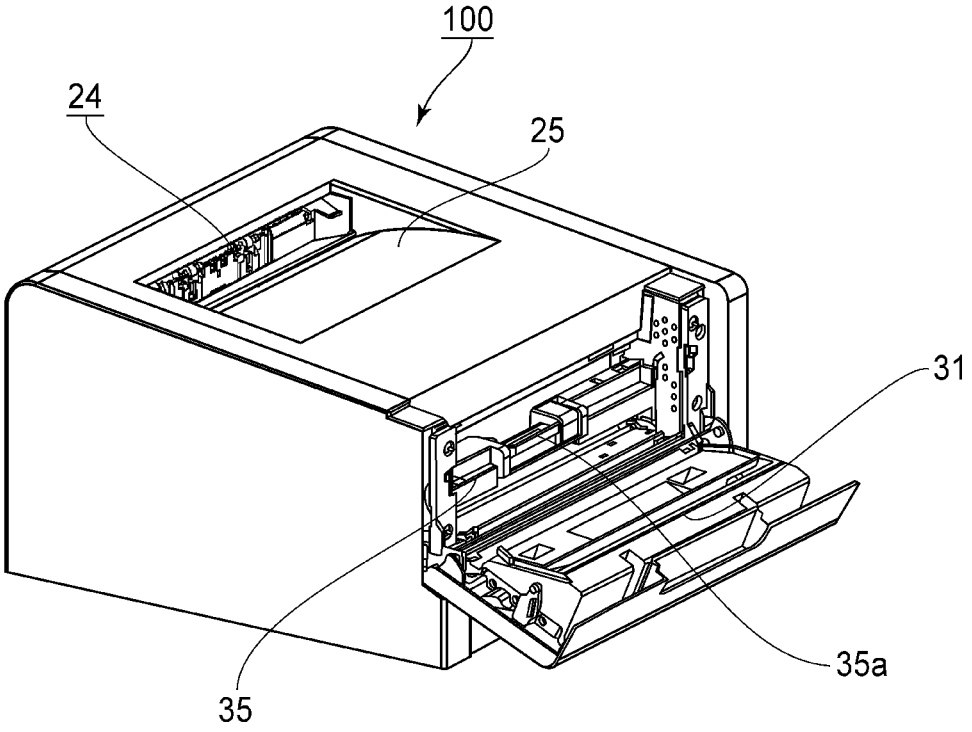
FIG. 3 is a perspective view of an outer appearance showing a state in which the door of the image forming apparatus in Embodiment 1 is open.
Figure 4:
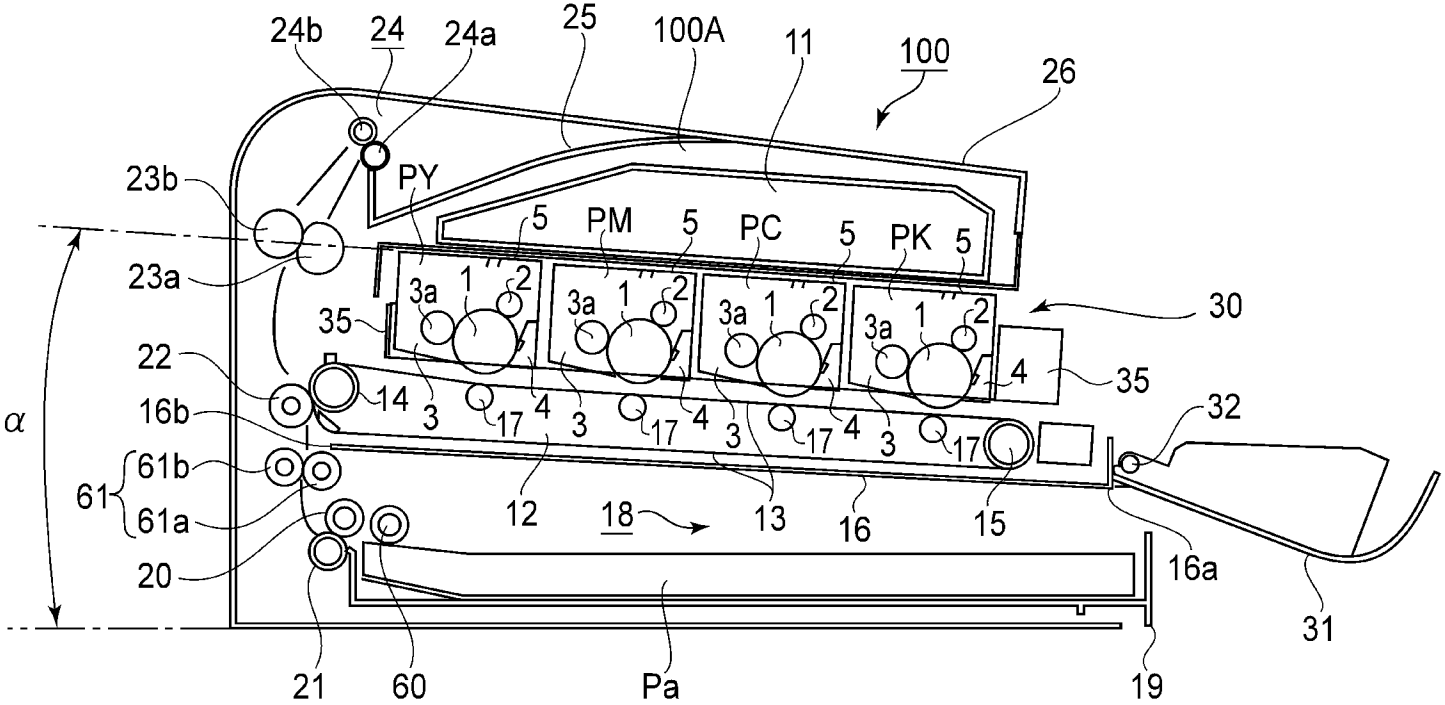
FIG. 4 is a principal sectional view showing the state in which the door of the image forming apparatus in Embodiment 1 is open.

In this embodiment, the door 31 can be opened and closed and can be rotationally moved relative to the apparatus main assembly 100A about a horizontal (lateral) shaft (hinge shaft) 32 provided at a lower portion of the door 31. That is, the door 31 is rotated about the hinge shaft 32 so that it can be placed in a closed state with respect to the apparatus main assembly 100 as shown in FIGS. 1 and 2. By closing the door 31, the opening 30 is closed. Further, the door 31 is rotated frontward with respect to the apparatus main assembly 100*a*, about the hinge shaft 32 so that it can be placed in an open state from the apparatus main assembly 100A as shown in FIGS. 3 and 4. As a result, the opening 30 at the front surface of the apparatus main assembly 100A is largely opened. A finger placement portion 31*a* for opening/closing the door 31 is provided to the door 31.

Inside the opening 30 of the apparatus main assembly 100A, a cartridge tray 35 as a cartridge supporting member is held slidably movable in arrow D1 and D2 directions. The movement direction of the tray 35 is constituted so that the tray 35 is, similarly as in the case of the sheet feeding tray 19, movable in the direction crossing the axes of the pick-up roller 60, the sheet feeding roller 20 and the separation roller 21. Further, rearward movement of the tray 35 is prevented (limited) by a positioning shape portion 35*g* provided on the tray 35 and a tray positioning shape portion 47 of the apparatus main assembly 100A (FIG. 17), and frontward movement of the tray 35 is prevented (limited) by a (safety) stopper claw (movement preventing (limiting) means) 35*f* (FIG. 17) of the tray 35. Incidentally, as shown in FIG. 17, by disposing the positioning shape portion 35*g* and the stopper claw 35*f* adjacent to each other, a positional error between these portions is reduced. Further, compared with a constitution in which a shape portion corresponding to the positioning shape portion 35*g* is disposed at a rear end of the tray 35, positioning accuracy is improved by ease of ensuring of dimensional accuracy and a small amount of deformation due to thermal expansion. A constitution for enabling such arrangement of the positioning shape portion 35*g* and the tray positioning shape portion 47 will be described later.

Then, by gripping a grip portion (movement prevention releasing (eliminating) means) 35*a* provided at a portion of a front-side tray frame exposed at the opening 35, the stopper claw 35*f* (FIG. 17) of the tray is disengaged from a hole 40 of a main assembly side plate 40, so that the tray 35 is slid and moved in the frontward direction (D1 direction).

Figure 5:
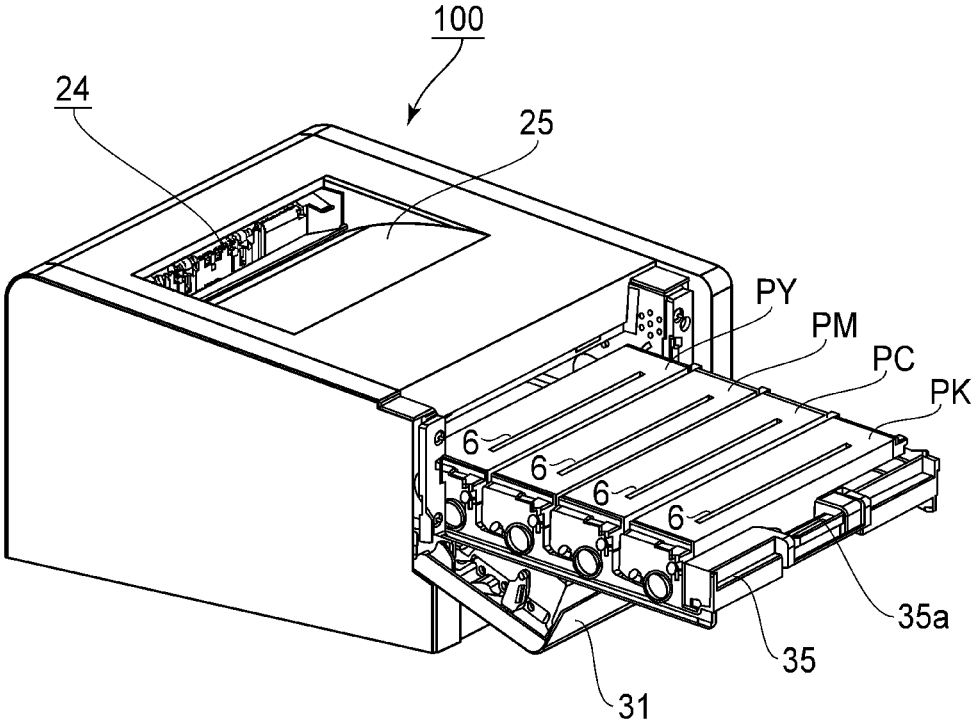
FIG. 5 is a perspective view of an outer appearance showing a state in which a tray of the image forming apparatus in Embodiment 1 is pulled out.
Figure 6:
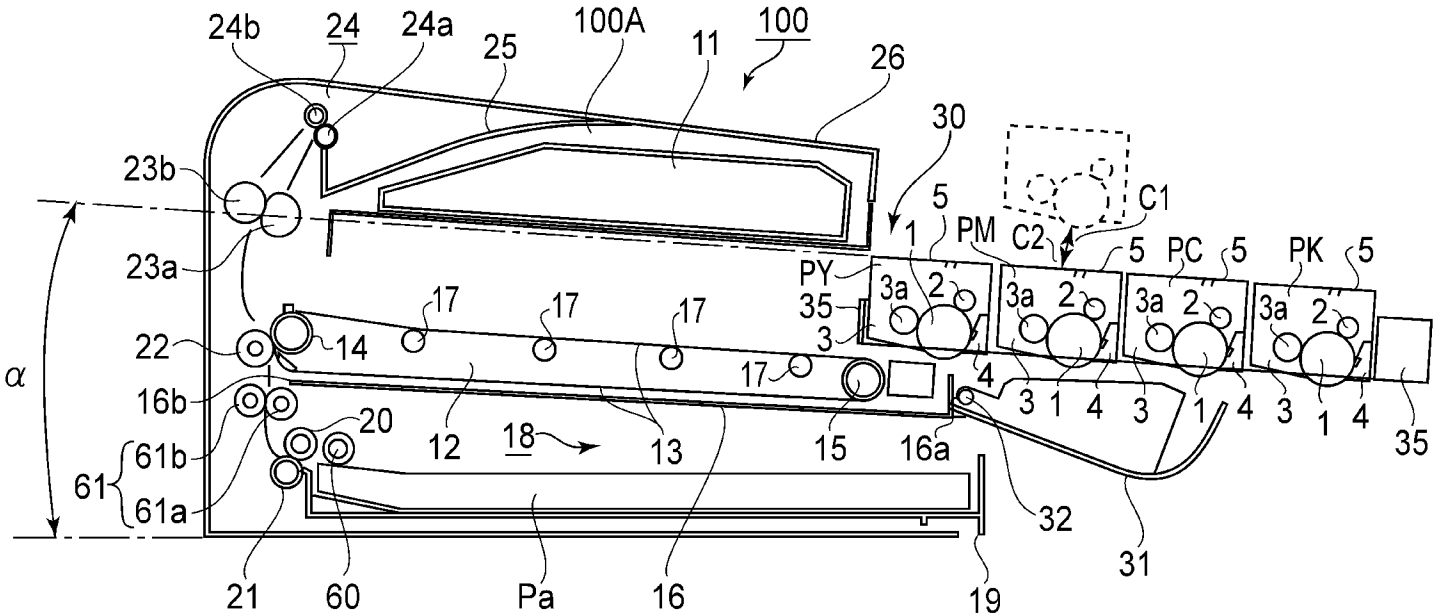
FIG. 6 is a principal sectional view showing the state in which the tray of the image forming apparatus in Embodiment 1 is pulled out.

Then, as shown in FIGS. 5 and 6, the tray 35 is pulled out sufficiently through the opening 30 to a mounting and demounting position located outside the apparatus main assembly 100A.

As a result, the entire four (first to fourth) cartridges P held by the tray 35 pass through the opening 30 and are exposed to the outside of the apparatus main assembly 100A, so that upper (top) surfaces of all the cartridge P are exposed. When the tray 35 is pulled out by a sufficient predetermined distance, the tray 35 is prevented by an unshown stopper portion from being pulled out further. The tray 35 is held in a predetermined mounting and demounting position state by a tray holding rail and the door 31.

The tray 35 supports each cartridge P so as to be detachably movable upward (in an arrow C1 direction). Further, the tray 35 supports each cartridge P by moving each carriage P downward (in an arrow C2 direction). As shown by a broken line in FIG. 6, a spent cartridge P to be replaced is raised and removed above from the tray 35 in the arrow C1 direction. Then, a fresh cartridge P is engaged in and placed on the tray 35 from above.

In the above, the tray 35 is the movable member provided movably in the direction crossing the axial direction of the drum 1 of each cartridge P. Further, the tray 35 is moved to a mounting and demounting position (FIG. 6), an image forming position (FIG. 2) and an inside position (FIG. 4). At the mounting and demounting position (FIG. 6), each cartridge P is detachably mountable to the apparatus main assembly 100A in the outside of the apparatus main assembly 100A. At the image forming portion (FIG. 2), the electrostatic latent image can be formed on the drum 1 and further the drum 1 contacts the belt 13 and thus the developer image formed on the drum 1 is transferable onto the belt 13. Further, at the inside position (FIG. 4), the tray 35 is moved upward from the image forming position and can be made movable between the inside position of the apparatus main assembly A and the mounting and demounting position in a state in which the drum 1 is spaced from the belt 13.

FIGS. 7 and 8 are perspective views each showing an outer appearance of the cartridge. FIG. 7 is the perspective view as seen from a driving side, and FIG. 8 is the perspective view as seen from a non-driving side. The cartridge is an assembly having a laterally elongated box-like shape in which the axial direction of the drum 1 is the left-right direction which is a longitudinal direction. The drum 1 is provided and supported rotatably between bearing portions 51 and 52 which are provided at a right-side surface portion and a left-side surface portion, respectively, of the cartridge frame 5. The right-side bearing portion 51 is provided with a coupling engaging portion 53 as a drum-driving force inputting portion. Further, at the right-side surface portion, a coupling engaging portion 54 as a developing roller-driving force inputting portion for driving the developing roller 3*a* is provided. In the above-described cartridge, the side where the coupling engaging portions 53 and 54 are provided is the driving side, and the left-side surface portion in an opposite side to the driving side is the non-driving side, the cartridge is provided with a rotation stopper 57 and a projection 56 in each of the left and right sides.

Figure 9:
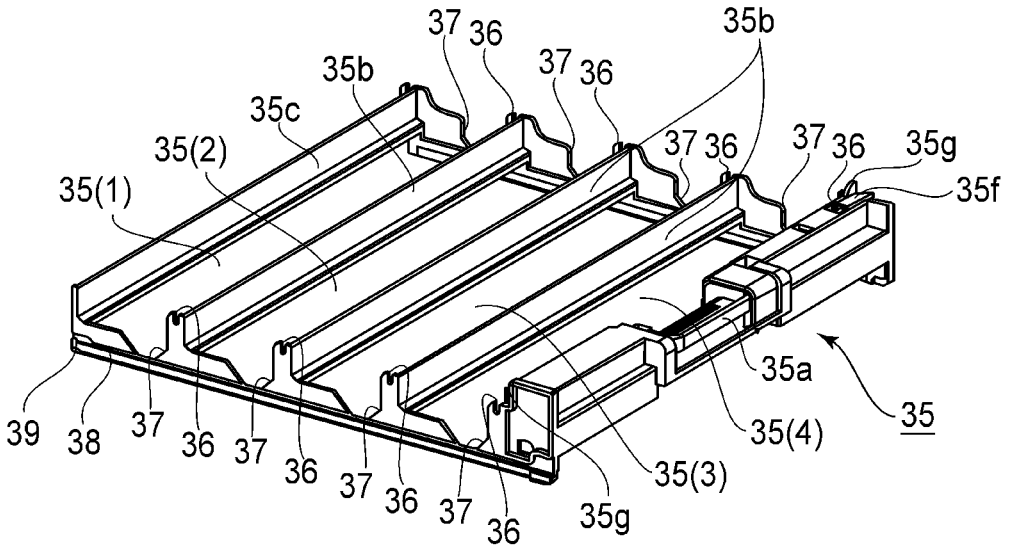
FIG. 9 is a perspective view of the tray in Embodiment 1.
Figure 10:
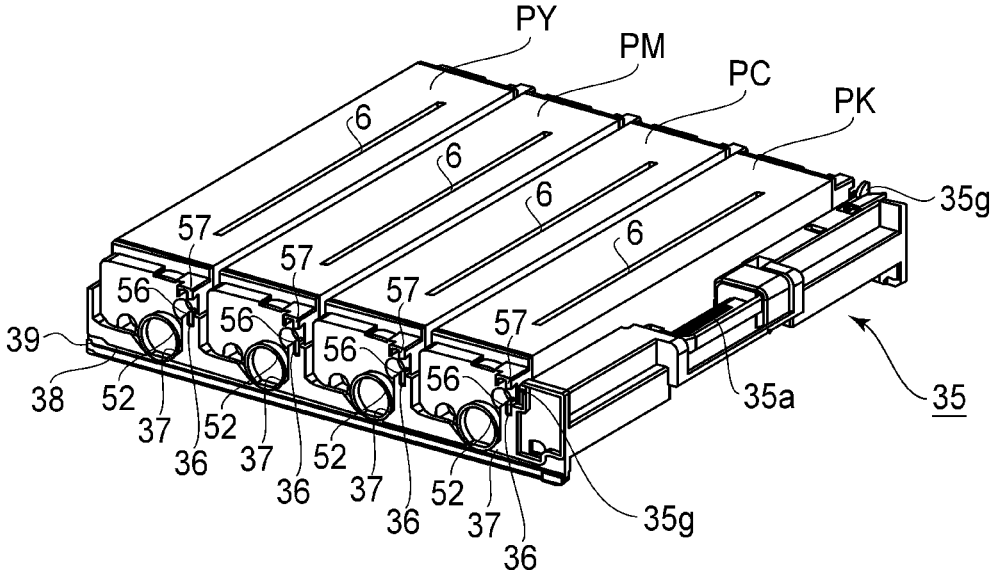
FIG. 10 is a perspective view showing a state in which cartridges are mounted on the tray in Embodiment 1.
Figure 11:
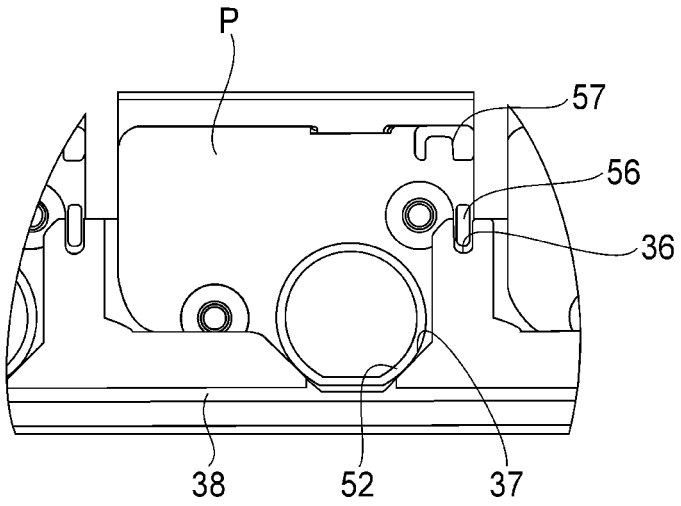
FIG. 11 is a side view showing a state in which the cartridge is mounted on the tray in Embodiment 1.

FIG. 9 is a perspective view of an outer appearance of the tray 35. The tray 35 includes a rectangular large frame portion, and the inside of the large frame portion is substantially equally partitioned into four areas by three partitioning plates 35*b* with respect to the front-rear direction thereof, so that first to fourth elongated small frame portions 35(1) to 35(4) from a rear frame plate 35*c* side to a front frame plate 35*b* side are formed in this order. Each of the small frame portions 35(1) to 35(4) is a portion where the cartridge P is to be held. In each of the left and right sides of each of the small frame portions 35(1) to 35(4), bearing portion 37 and a groove (slot) 36 are provided. FIGS. 10 and 11 are schematic views each for illustrating a state in which each cartridge P is mounted in a pulled-out state of the tray 35 shown in FIG. 5. The bearing portion 52 of the cartridge P contacts the bearing portion 37, so that the cartridge P is supported. The projection 56 of the cartridge P enters the groove 36 to stop rotation of the cartridge P. However, there is play between the projection 56 and the groove 36, so that the cartridge P is held rotatably correspondingly to the play. In FIGS. 10 and 11, the non-driving side is shown, but also in the driving side, similarly, the bearing portion 51 of the cartridge P is received by the bearing portion 37, and the projection 56 enters the groove 36 to stop the rotation of the cartridge P, but there is the play between the projection 56 and the groove 36 similarly as in the non-driving side. Further, there is no obstructing portion with respect to the coupling engaging portions 53 and 54 and therefore when the tray 35 is inserted in the main assembly and is located at the image forming position, a driving mechanism of the apparatus main assembly 100 can directly access to the coupling engaging portions 53 and 54.

Figure 12:
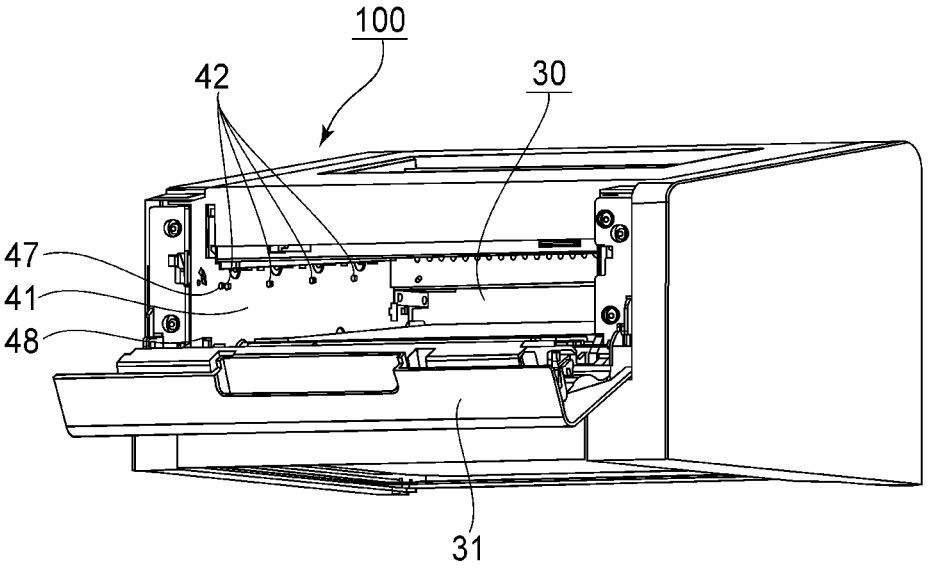
FIG. 12 is a perspective view showing an inside of an apparatus main assembly in a state in which the toner in Embodiment 1 is removed.

As described above, each cartridge P is inserted from above into the corresponding small frame portion of the tray 35 and is supported by the tray 35, and can be removed by only raising the cartridge P, so that the process cartridge can be easily replaced. FIG. 12 is a perspective view showing a state the door 31 is opened and the inside of the apparatus main assembly 100A is seen from the opening 35 side in a state in which the tray 35 is removed, wherein a side plate 41 is provided with rotation stopper shape portions 42 at four positions corresponding to the cartridge P. Further, in alignment with the rotation stopper shape portions 42, a tray positioning shape portion 47 for positioning the tray 35 is provided. Similarly, also a side plate in the opposite side is provided with the four rotation stopper shape portion 42 and the tray positioning shape portion 47 (not shown).

Next, with reference to FIGS. 13 to 16, a constitution in which the tray 35 and the cartridge P are moved between the image forming position and the mounting and demounting position in interrelation of the closing and opening operation of the door 31 will be described.

As shown in FIG. 13, the door 31 is provided with an arm member 33, and the side plate 41 is provided with a cam plate 44, and a slidable plate 43 is provided movably on the cam plate 44 in the front-rear direction. By the opening and closing operation of the door 31, the slidable plate 43 is moved in the front-rear direction by the arm member 33 ((a) and (b) of FIG. 13). Parts (a) and (b) of FIG. 14 are perspective views each showing a state in which the cam plate 44 and its peripheral portion are extracted, and the door 31 and the side plate 41 are omitted from illustration. Inside the side plate (not shown), a rail 45 and a positioning plate 46 are provided. The positioning plate 46 constitutes a part of a main assembly casing of the image forming apparatus 100 similarly as the side plate 41 and is provided with a positioning portion 46*a*. The rail 45 is provided with bosses 45*a* and 45*b*, and enters a cam shape portion 44*a* of the cam plate 44 through a hole (not shown), and further the boss 45*a* is inserted into a hole 43*a* of the slidable plate 43. The state of the door 31 (not shown) is changed from an open state of (a) of FIG. 14 to a closed state of (b) of FIG. 14, so that the arm member 33 is rotated to move the slidable plate 43 rearward, thus pushing the boss 45*a* of the rail 45 to move the rail 45 rearward. By the rearward movement of the rail 45, the bosses 45*a* and 45*b* are guided by the cam shape portion 44*a* of the cam plate 44 to be lowered. Parts (a) and (b) of FIG. 15 are sectional views each showing a state of a combination of the tray 35 and the cartridge P, and (a) and (b) of FIG. 15 are side views each showing the state of the combination of the tray 35 and the cartridges P, in which (a) of each of FIGS. 14 and 15 shows the open state of the portion 31, and (b) of each of FIGS. 14 and 15 shows the closed state.

The tray 35 is supported by the rail 45 at its left and right ends, and is moved upward and downward with raising and lowering of the rail 45 in a state a pulling-out direction of the tray 35 is positionally determined by the tray positioning shape portion 47, and the positioning shape portion 35*g* and stopper claw 35*f* on the tray 35 (FIG. 17). From the state of (a) of each of FIGS. 15 and 16, the portion 31 is closed, so that the tray 35 and the cartridges P mounted on the tray 35 are lowered to the state of (b) of each of the FIGS. 15 and 16. Thus, the bearing portion 52 of the cartridge P is engaged with the positioning portion 46*a* of the positioning plate 46. Then, the rotation stopper 57 is engaged with the rotation stopper shape portion 42 to stop the rotation of the cartridge P, so that the positioning of the cartridge P relative to the apparatus main assembly 100A and the stop of the rotation of the cartridge P are completed. At this time, a lowering amount of the rail 45 is set so that the tray 35 can be lowered even after the bearing portion 52 of the cartridge P is engaged with the positioning portion 46*a* of the positioning plate 46 to stop the lowering of the tray 35. Further, a gap is created between the bearing portion 37 of the tray 35 and the bearing portion 52 of the cartridge P, so that the positioning of the cartridge P is prevented from being adversely affected. Further, as described above, play is provided also between the groove 36 of the tray 35 and the projection 56 of the cartridge P. For that reason, also in this side, the rotation stop of the cartridge P is prevented from being adversely affected. Further, a guidable amount of the play is set so that the rotation stopper 57 can be engaged with the rotation stopper shape portion 42 during the lowering of the tray 35 and the cartridge P.

In order to change the position of the tray 35 from the image forming position to the inside position, the door 31 is made open, so that the reverse of the above-described process is enabled. At this time, a space, shown at a portion A in (a) of FIG. 15 and (a) of FIG. 16, at a periphery of the rotation stopper shape portion 42 and the tray positioning shape portion 47 is in a shape-free state, with respect to both the tray 35 and the cartridge P, along the pulling-out direction of the tray 35. For that reason, the cartridge P located in the rear side with respect to the pulling-out direction can be pulled out without being obstructed by the rotation stopper shape portion 42 and tray positioning shape portion 47 which correspond to those of the front-side cartridge P. Incidentally, the above description was made with respect to the non-driving side, but the same constitution is employed also in the driving side. Further, in this embodiment, it is assumed that the rotation stopper shape portion 42 and the tray positioning shape portion 47 are cylindrical bosses and are metal shafts which are clamped to the side plates 40 and 41. However, as shown in FIG. 18, the portions 42 and 47 can also be a shape portion 42*a* formed by bending the side plates 40 and 41, thus reducing the number of parts to realize cost reduction.

Further, in this embodiment, the rotation stopper is provided in both the driving side and the non-driving side. However, the rotation stopper may also be provided in either one side if the process cartridge has sufficient rigidity and can hold its attribute by itself. That is, as in this embodiment, the constitution in which the rotation stopper is provided in both sides to decrease the rigidity of the process cartridge as a member to be exchanged (replaced), thus realizing the cost reduction may also be employed. Further, the rail 45 was constituted so that it had the above-described shape portions only at a lower portion of the tray 35 but had not the shape portions between the tray 35 or the process cartridge and each of the side plates 40 and 41. By that constitution, it is possible to make a width of the image forming apparatus small and to make the rotation stopper shape portion 42 and the rotation stopper 57 minimum necessary in size. Incidentally, in this embodiment, the cartridges P are disposed in an inclined state with respect to the front-rear direction. Further, in this embodiment, the belt 13 was used as the intermediary transfer member. However, also in a constitution in which the recording material is passed between the photosensitive drum 1 and the belt 13 to transfer the image from the photosensitive drum 1 onto the recording material directly, the mounting and demounting mechanism of the process cartridge can be similarly realized in this embodiment.

In the image forming apparatus in this embodiment, a mounting and demounting operation is performed by the moving operation of the tray 35 in the arrangement direction of the cartridges P, a height necessary for the operation is prevented from being increased by providing a cover or the like for being opened upward and being closed during not only the image formation but also the exchange of the cartridge. Further, while providing an easy process cartridge exchanging means through the operation of the apparatus main assembly 100A from the front surface, the positioning and rotation stop of each cartridge P during the image formation can be performed with high accuracy the image forming apparatus main assembly 100A without via the tray 35.

(Inclined Arrangement of Tray)

Further, as shown in FIG. 16, the rail 45 is provided with an inclined portion having an inclination angle α with respect to the horizontal direction. The rail 45 is provided in the apparatus main assembly 100A so as to be located above with respect to the vertical direction in a side in the neighborhood of the opening/closing door 31 and be located below with respect to the vertical direction in the rear side of the apparatus main assembly 100A in an obliquely inclined state. Further, also the tray 35 movably supported by the rail 45 is in the inclined state with the angle α with respect to the horizontal direction at the image forming position and the inside position. That is, as shown in FIGS. 2 and 4, the tray 35 is, at the image forming position and the inside position, in a state in which a portion of the tray in a side opposing, with respect to the vertical direction, another side of the sheet feeding tray 19 with respect to the feeding direction is lower (in height) than a portion of the tray 35 in a side opposing a (one) side of the sheet feeding tray 19 with respect to the vertical direction. Further, when the tray 35 is pulled out, as shown in FIG. 6, the tray 35 is moved so as to be slid obliquely downward along the rail 49. Further, the tray 35 is moved to the mounting and demounting position in a state in which the inclination angle α is maintained. Accordingly, at the mounting and demounting position, compared with the case of a horizontal state, the cartridges PY and PM which are disposed in the upstream side with respect to the pulling-out direction of the tray 35 are in a state in which the cartridges are easily mounted and demounted. In this embodiment, as described above, the rail 45 is somewhat translated upward in interrelation with the opening/closing door 31 in order to space the drum 1 from the belt 13, but the inclination angle of the rail 45 is not changed, so that there is no generation of a large dead space.

Further, as shown in FIGS. 1 to 6, also the stay 16 as the partitioning member is inclined in the same direction as that of the rail 45. The inclination angle of the stay 16 is not required to be made equal to the inclination angle α of a guide rail 24 but may only be required to have the same inclination direction. Further, in this embodiment, members such as the belt 13 and the scanner unit 11 which are provided above the stay 16 are provided in an inclined state with respect to the same direction with the angle α. As a result, it becomes possible to incline also an upper surface 26 of a casing surface of the image forming apparatus 100. Also the inclination direction of the upper surface 26 is the same as those of the rail 45, the stay 16 and the like.

As described above, in the conventional image forming apparatus, as shown in FIG. 19, there was a space 227 between a state feeding cassette 202 and the stay 216. The space 227 is not used for some purpose but constitutes the dead space. That is, a sheet feeding portion constituted by a sheet feeding roller 203, a separation roller 204, a conveying roller 205 and the like is required to be provided above a bundle of sheets Pa stacked in the sheet feeding cassette 202 by any means in the constitution. Further, there is a need to provide a transfer portion, constituted by an intermediary transfer belt 211, a secondary transfer belt 213 and the like, above the sheet feeding portion. Due to such a constraint of a constitution regarding the arrangement of the sheet feeding portion and the like, in the case where a tray 221 for supporting a cartridge 206 was provided horizontally, the space 227 had to be provided between the sheet feeding cassette 202 and the intermediary transfer belt 211. In order to reduce the space 227, it would be considered that the sheet feeding portion is downsized in the up-down direction, but when the sheet feeding portion is excessively downsized, curvature of a conveying path of the sheet Pa becomes large, so that there is a possibility that the downsized sheet feeding portion adversely affects a feeding performance of the sheet Pa.

In this embodiment, with respect to the sheet Pa feeding direction, a region above the sheet feeding tray 19 in another end side with respect to the vertical direction was effectively used, and the tray 35, the stay 16 and the like were provided in the inclined state. A broken line indicated at an upper right portion of the image forming apparatus 100 in FIG. 2 shows a contour of a casing of the conventional image forming apparatus. When this contour is compared with a contour of the image forming apparatus 100 in this embodiment, it is understood that the casing of the image forming apparatus 100 in this embodiment is downsized compared with that of the conventional image forming apparatus by an amount corresponding to the space at the upper right portion on the upper surface 26 of the image forming apparatus 100.

Further, on the tray 35, the four cartridges P are mounted. When the user pulls out the tray 35, a force such that the tray 35 is slid downward along the inclined portion is applied by the self-weight of the cartridges P. The force assists the pulling-out operation, so that an operating force when the tray 35 is pulled out is reduced.

Further, in this embodiment, as shown in FIGS. 2 to 6, a rear-side end portion 16*b* of the stay 16 was disposed above an upper outer-diameter portion of the conveying roller pair 61. This is similar to that in the conventional image forming apparatus. However, a front-side end portion 16*a* of the stay 16 is disposed below a lower outer-diameter portion of the conveying roller pair 61 with respect to the vertical direction. That is, a horizontal line H passing through the front-side end portion 16*a* of the stay 16 in FIG. 2 passes below the lower outer-diameter portion of the conveying roller pair 61. Thus, with respect to the vertical direction in another end side of the sheet feeding tray 19, an upper region is effectively used, and the stay 16 is disposed in the inclined state, so that the downsizing of the image forming apparatus 100 can be realized. Further, even when the position of the front-side end portion 16*a* of the stay 16 is located below the upper outer-diameter portion of the conveying roller pair 61, there is an effect of realizing the downsizing of the image forming apparatus 100.

This embodiment is described above, but a value of the inclination angle $\alpha$ of the rail 45 is not particularly limited. Further, in this embodiment, the cartridge P supported by the tray 35 was described by using the process cartridge. However, with respect to the cartridge P supported by the tray 35, a drum cartridge for supporting the drum 1 and the developing cartridge for supporting the developing roller 3 may also be supported by the tray 35 as separate members. Further, a constitution in which the drum 1 is directly supported by the tray 35 and the developing cartridge for supporting the developing roller 3 is detachably mountable to the tray 35 may also be employed.

According to the present invention, the image forming apparatus can be downsized by effectively using a space above an accommodating portion, with respect to the vertical direction, for accommodating the recording material.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 115845/2012 filed May 21, 2012, which is hereby incorporated by reference.

What is claimed is:

1. An image forming apparatus for forming an image on a plurality of recording materials, said image forming apparatus comprising:

an accommodating portion for accommodating the plurality of recording materials;

feeding means for feeding the recording materials from an end side of said accommodating portion; and a cartridge supporting member provided above said accommodating portion with respect to a vertical direction, wherein said cartridge supporting member is movable, in a direction perpendicular to an axial direction of said feeding means, to a mounting and demounting position where a plurality of cartridges is detachably mountable outside a main assembly of said image forming apparatus and to an image forming position where the plurality of cartridges is capable of forming the image inside the main assembly, wherein at the image forming position, a side of said cartridge supporting member that opposes another end side of said accommodating portion with respect to the vertical direction is lower with respect to the vertical direction than that of a side of said cartridge supporting member that opposes the end side of said accommodating portion, and wherein when said cartridge supporting member is moved from the image forming position to the mounting and demounting position, said cartridge supporting member is moved obliquely below with respect to the vertical direction.

2. An image forming apparatus according to claim 1, wherein each of the cartridges is a process cartridge including a photosensitive drum and a developing device for developing an electrostatic latent image formed on the photosensitive drum, and wherein said process cartridge is detachably mountable to said cartridge supporting member.

3. An image forming apparatus according to claim 2, further comprising a transfer member onto which a developer image formed on the photosensitive drum is to be transferred, wherein said transfer member is provided between said cartridge supporting member and said accommodating portion with respect to the vertical direction.

4. An image forming apparatus according to claim 1, wherein said cartridge supporting member includes a photosensitive drum, and wherein each of the cartridges includes a developing means for developing an electrostatic latent image formed on the photosensitive drum and is detachably mountable to said cartridge supporting member.

5. An image forming apparatus according to claim 4, further comprising a transfer member onto which a developer image formed on the photosensitive drum is to be transferred, wherein said transfer member is provided between said cartridge supporting member and said accommodating portion with respect to the vertical direction.

6. An image forming apparatus according to claim 5, wherein said feeding means includes a sheet feeding roller for feeding an uppermost one of the recording materials stacked in said accommodating portion and a conveying roller pair, provided downstream of the sheet feeding roller with respect to a feeding direction of the recording materials, for feeding the recording material to a transfer position where the developer image is to be transferred from said transfer member onto the recording material.

7. An image forming apparatus according to claim 6, further comprising a partitioning member for partitioning between said cartridge supporting member and said accommodating portion with respect to the vertical direction, wherein a side of said partitioning member that opposes said another end of said accommodating portion is lower than the conveying roller pair with respect to the vertical direction.

8. An image forming according to claim 1, wherein said accommodating portion is movable in the direction perpendicular to the axial direction of said feeding means.

9. An image forming apparatus according to claim 1, wherein the cartridges accommodates developers of yellow, cyan, magenta and black, respectively.

* * * * *